US007423544B2

(12) United States Patent
Cartwright et al.

(10) Patent No.: US 7,423,544 B2
(45) Date of Patent: Sep. 9, 2008

(54) METHOD OF SELECTING OPERATION IN A LINE-POWERED MODULE

(75) Inventors: Kirby W. Cartwright, Dublin, OH (US); Scott Young, Aurora, IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 358 days.

(21) Appl. No.: 11/445,575

(22) Filed: Jun. 2, 2006

(65) Prior Publication Data

US 2007/0290833 A1 Dec. 20, 2007

(51) Int. Cl.
*G08B 21/00* (2006.01)

(52) U.S. Cl. ..... 340/644; 340/506; 340/538; 340/628; 340/632

(58) Field of Classification Search ..... 340/644, 340/506, 538, 533, 310.11, 628, 632, 693.6, 340/524, 507, 525, 531; 307/1
See application file for complete search history.

(56) References Cited

U.S. PATENT DOCUMENTS

| | | | | |
|---|---|---|---|---|
| 3,952,760 | A | 4/1976 | Caldwell | |
| 5,705,979 | A * | 1/1998 | Fierro et al. | 340/517 |
| 6,326,880 | B1 * | 12/2001 | Tice | 340/286.05 |
| 6,353,395 | B1 * | 3/2002 | Duran | 340/691.1 |
| 6,611,204 | B2 | 8/2003 | Schmurr | 340/286.01 |
| 6,791,453 | B1 | 9/2004 | Andres et al. | 340/538 |
| 2003/0058623 | A1 | 3/2003 | Veil et al. | |

FOREIGN PATENT DOCUMENTS

GB 2281995 A 3/1995

OTHER PUBLICATIONS

FIREX Smoke Alarm; Item Nos. 0242, 0244; Smoke Alarms/Signaling Device Kit for Hard of Hearing; 1998 Maple Chase Company.
FIREX Relay Module Instruction Manual; Item No. 0499; Maple Chase Company 1998.
Search Report dated Oct. 8, 2007.

* cited by examiner

*Primary Examiner*—Toan N Pham
(74) *Attorney, Agent, or Firm*—Andrus, Sceales, Starke, Sawall, LLP

(57) ABSTRACT

A line-powered module that is selectively operable in one of a plurality of modes of operation based upon the value of a selection signal. The line-powered module includes a control unit that selectively operates the module in one of the plurality of modes of operation based upon the value of a selection signal received by the control unit. The line-powered module includes a selection input that is coupled to the control unit such that the selection signal can be received at the selection input. Preferably, the selection input receives a selection wire that can be moved between different points of connection to define the plurality of states of the selection signal. Based upon the connection of the selection wire, the control unit operates the line-powered module in one of the plurality of modes of operation.

12 Claims, 3 Drawing Sheets

SELECT WIRE CONNECTION CHART
| RESPONDS TO: | CONNECTED TO: |
|---|---|
| CO ALARM ONLY | HOT |
| SMOKE ALARM ONLY | NOT CONNECTED |
| BOTH SMOKE & CO ALARMS | NEUTRAL |
*FIG. 3*
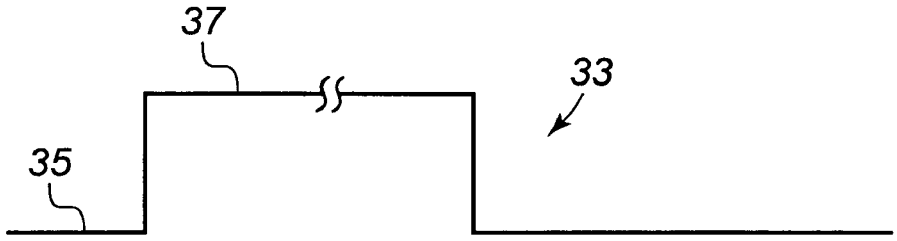
*FIG. 4*
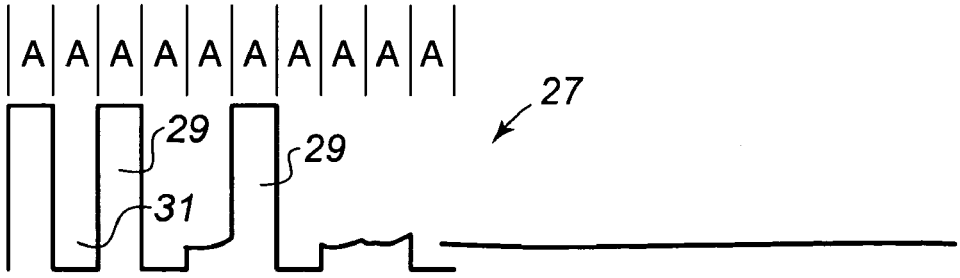
*FIG. 5*

METHOD OF SELECTING OPERATION IN A LINE-POWERED MODULE

FIELD OF THE INVENTION

The present invention generally relates to a line-powered module that can be installed in a junction box and whose operation can be selectively modified depending upon the application. More specifically, the present invention relates to a line-powered module that receives a selection signal such that a control unit within the line-powered module can selectively operate the module in one of a plurality of modes of operation.

BACKGROUND OF THE INVENTION

Hazardous condition detection systems are well known and are required by building codes of most communities. Typical hazardous condition detection alarm systems include alarms that respond to the detection of either smoke or carbon monoxide (CO) within the building.

Since the early detection of a hazardous condition and the notification of the occupant as soon as possible has proven to be the best possible way to provide the building occupants with the required time to exit the building, many building codes, including the U.S. National Fire Code, require the hazardous condition detectors located throughout a building to be electrically connected to each other in a system such that when any of the detectors is activated, all of the detectors sound an alarm. Through the interconnection of the individual detectors, a sleeping occupant on the second floor of a building will be awakened by the detection of the hazardous condition anywhere throughout the dwelling, such as the basement. To ensure that smoke detectors throughout the home or building can be connected, most manufacturers create detectors that are compatible with a three-wire interconnection. In a standard three-wire interconnection, the first wire is utilized to supply voltage to the detector, the second wire is used as the return, and the third wire provides the ability for the interconnected detectors to provide signals between the detectors.

Since the series of interconnected hazardous condition detectors can include detectors of different varieties, such as a smoke alarm unit, a carbon monoxide alarm unit or a combination smoke and carbon monoxide alarm unit, the signals sent along the interconnect line must vary depending upon the type of hazardous condition detected. For example, if one of the interconnected hazardous condition detectors detect the presence of smoke, it is required by UL Standards that the interconnected detectors each generate only the standard temporal pattern for the detection of smoke, which is different than the temporal pattern used for the detection of carbon monoxide.

The Schmurr U.S. Pat. No. 6,611,204, the disclosure of which is incorporated herein by reference, teaches a system and communication method that allows the interconnected hazardous condition detectors to receive the interconnect signal and generate the proper temporal pattern based upon the type of hazardous condition detected as indicated by the interconnect signal. The system taught by the Schmurr '204 patent allows various types of hazardous condition detectors to be interconnected and properly operate to generate the proper audible alarm signal.

Although the interconnected hazardous condition detection alarm system taught by the Schmurr '204 patent has proven to be effective in relaying audible alarms throughout a household, it is desirable to provide additional audible or visual indications or actions based upon the detection of the hazardous condition. Presently, relay modules, such as the Firex Model No. 0499, exist that connect a relay device to a series of interconnected smoke alarms. Upon the detection of a smoke condition by one of the detectors, the interconnect signal on the interconnect line causes a relay within the relay module to move from a first position to a second position. Various auxiliary devices, such as strobe lights, sirens, exit signs, warning lights, fire doors, exhaust fans or other indicators can be connected to the relay such that when the smoke condition is detected, the relay moves to the second position and activates each of these auxiliary devices.

Although the currently available relay modules function well to respond to the detection of a smoke condition within a series of interconnected smoke alarms, the currently available relay modules are unable to respond to either a detected first condition or a detected second condition, or both, in a connected system of different types of hazardous condition detectors. Therefore, a need exists for a relay module that can be configured to respond to either a first sensed condition, a second sensed condition or both to provide activation of auxiliary devices connected to the relay module.

In addition to relay modules that can be incorporated as part of a series of interconnected hazardous condition detectors, various other line-powered modules can be installed in a junction box, such as flashers, light detectors and relays to control the operation of various other connected auxiliary devices. Currently available line-powered modules can operate in more than one mode of operation, such as relays that can be in either a normally opened or a normally closed position.

In currently available line-powered modules, an installer or electrician must select the mode of operation. One common method of selecting the mode of operation of a line-powered module requires the electrician to open an enclosure or box containing the module and moving a jumper or switch contained on a printed circuit board between different positions. The position of the switch or jumper within the module controls the operation of the device. Once the jumper or switch has been adjusted on the printed circuit board, the enclosure box is closed and the module can be installed within the junction box. Alternatively, the module may include an external switch that can be moved by the electrician to control the mode of operation of the line-powered module. This type of module also requires the electrician or installer to position the switch or toggle in the correct position.

SUMMARY OF THE INVENTION

The present invention is a line-powered, multi-function relay module that can be used with various connected devices, such as a series of interconnected hazardous condition detectors. The series of hazardous condition detectors are each interconnected with each other through an interconnect line such that when any of the hazardous condition detectors detects a first of second sensed condition, the hazardous condition detectors can communicate the detected condition with each other through the interconnect line.

The line-powered relay module includes an interconnect input that is connectable to the interconnect line to receive the interconnect signal from the series of hazardous condition detectors. The interconnect signal indicates the detection of either a first sensed condition or a second sensed condition by one or more of the hazardous condition detectors. Preferably, the first sensed condition is the detection of carbon monoxide while the second sensed condition is the presence of smoke.

A control unit contained within the line-powered module receives an indication of whether the first sensed condition or the second sensed condition was indicated by the interconnect signal. In addition to the indication of the type of sensed condition received by the relay module, the control unit also includes a selection input that receives a selection signal. Preferably, the selection signal is a signal that has at least three different states. Based upon the state of the selection signal, the control unit operates the module in one of a plurality of modes of operation.

The control unit is coupled to a relay such that the control unit can generate an activation signal to move the relay from a first position to a second position. In the preferred embodiment of the invention, the control unit generates the activation signal upon indication of the first sensed condition, the second sensed condition or either of the first and second sensed condition based upon the state of the selection signal provided to the control unit.

The three states of the selection signal can be selected by connecting a selection line or wire to the power supply line, the neutral line or by allowing the selection line to be floating. Although additional states are contemplated, such as connecting the selection line to the interconnect input, the three state embodiment is currently preferred. Based upon the state of the selection input, the control unit responds to only certain conditions indicated by the interconnect signal. In this manner, the line-powered module can selectively respond to either the first sensed condition, the second sensed condition or both the first and second sensed conditions. The use of the selection signal as an input to the control unit allows the line-powered module to operate in different modes, such that the module can be used with different types of auxiliary device that may need to respond to either the first sensed condition or the second sensed condition without having to utilize different relay modules. Further, the use of a selection wire to control the state of the selection signal allows an installer or electrician to connect the selection wire to either the power supply line or the neutral line using common components that are familiar to the electrician or installer.

BRIEF DESCRIPTION OF THE DRAWINGS

The drawings illustrate the best mode presently contemplated of carrying out the invention. In the drawings:

FIG. 3 is a table illustrating the response of the control unit to the different states of the selection signal;

FIG. 4 is a schematic representation of a typical interconnect signal present on the interconnect line to indicate the detection of smoke; and FIG. 5 is a schematic representation of a typical interconnect signal present on the interconnect line to indicate the detection of carbon monoxide.

DETAILED DESCRIPTION OF THE PREFERRED EMBODIMENT

Figure 1:
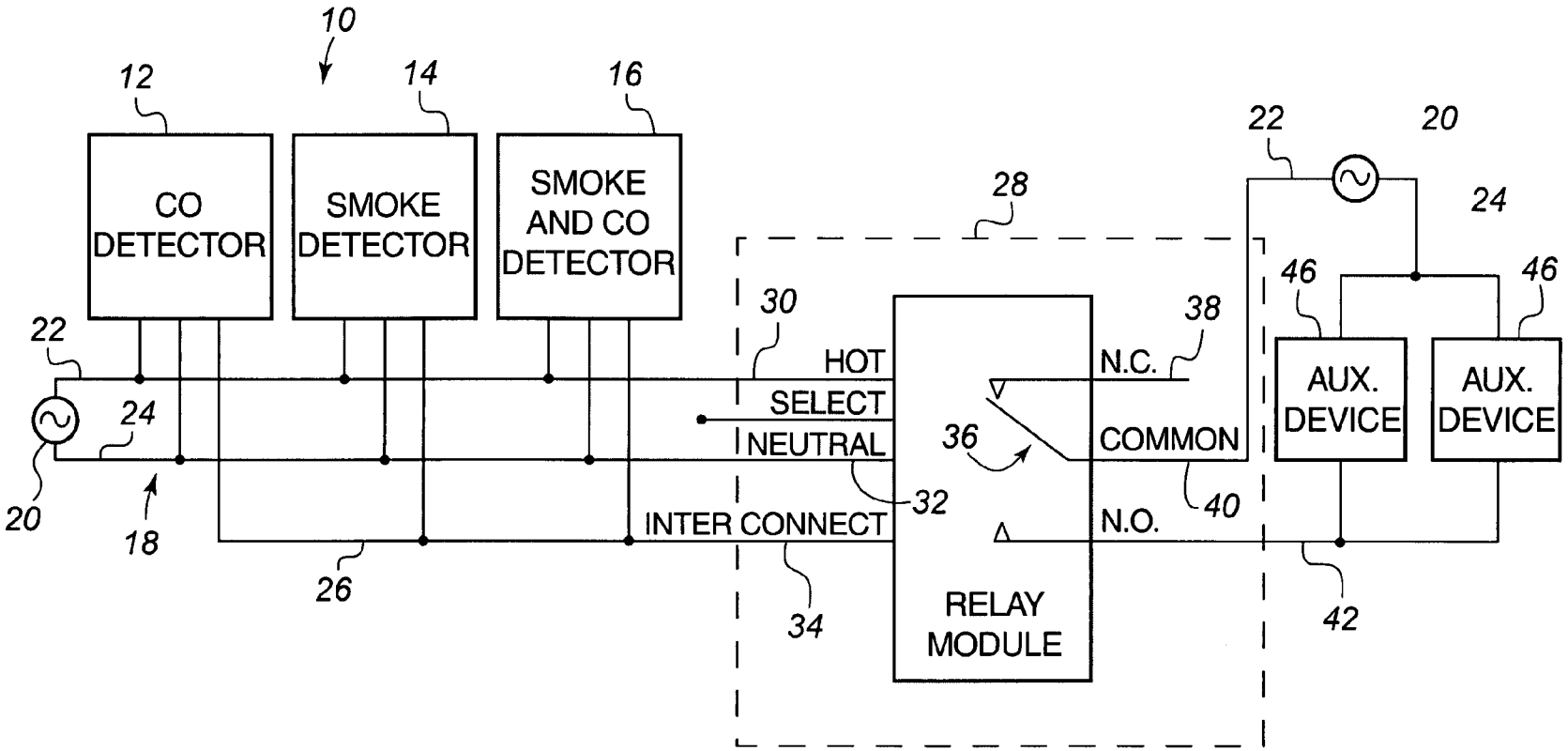
FIG. 1 is a schematic illustration of a line-powered relay module connected between a series of interconnected hazardous condition detectors and one or more auxiliary devices.

FIG. 1 illustrates a system 10 of interconnected hazardous condition detectors. In the embodiment of the invention illustrated in FIG. 1, the system includes different types of hazardous condition detectors, such as a carbon monoxide detector 12, a smoke detector 14 and a combination smoke and carbon monoxide detector 16. Although the system 10 shown in FIG. 1 illustrates one each of three different types of detectors, it should be understood that the interconnected hazardous condition detection system 10 could incorporate various different combinations of the three basic types of detectors 12, 14 and 16 illustrated in FIG. 1. Further, the hazardous condition detection system 10 could also incorporate only one type of detector, such as the combo detector 16, throughout the entire premises while operating within the scope of the present invention.

The interconnected hazardous condition detection system 10 utilizes a standard three-wire interconnect 18. The three-wire interconnect 18 provides main AC power from a source 20 to each of the various detectors 12, 14 and 16. The AC power from the source 20 is provided to each of the detectors by a power supply line (hot) 22 and a neutral line 24. As illustrated, each of the detectors is coupled to both the power supply line 22 and the neutral line 24. The three-wire interconnect system 10 further includes an interconnect line 26 that allows each of the detectors to communicate an interconnect signal between the various detectors.

As described previously with reference to the Schmurr '204 patent, it is important that the protocol of the interconnected hazardous condition detection system 10 allows for the interconnection of the various different types of detectors shown in FIG. 1. In view of these principles, the communication protocol for the interconnected hazardous condition detection system 10 allows each of the detectors to generate different interconnect signals for transmission on the single interconnect line 26. The detectors that are all connected to the interconnect line 26 will either understand certain signals and alarm appropriately, or the detectors will not understand the signal, ignore it and will not alarm at all.

In the embodiment of the invention illustrated in FIG. 1, the interconnect signal present along the interconnect line 26 is a digital signal that includes information relating to the type of hazardous condition detected by the detector 12, 14 or 16 that generated the signal. As an example, when the carbon monoxide detector 12 detects the presence of carbon monoxide in levels that exceed the alarm threshold for the detector 12, the carbon monoxide detector 12 enunciates a local, audible alarm signal and generates an interconnect signal along the interconnect line 26.

FIG. 5 illustrates a sample interconnect signal present along the interconnect line 26 when one of the detectors senses the presence of carbon monoxide. The carbon monoxide interconnect signal 27 includes a series of spaced pulses 29 each having a fixed duration. The series of pulses are separated by gaps 31 each also having the same duration. Although an example of the interconnect signal to indicate the detection of carbon monoxide is shown in FIG. 5, it should be understood that the interconnect signal could have many different configurations while operating within the scope of the present invention.

When the interconnect signal from the carbon monoxide detector 12 is present along the interconnect line 26, the smoke detector 14 and the combo detector 16 receive the interconnect signal, decode the signal and respond by generating an audible alarm that has the temporal pattern required for the detection of carbon monoxide.

Likewise, if the smoke detector 14 detects the presence of smoke in a concentration above an alarm threshold, the smoke detector 14 enunciates a local, audible alarm and generates an interconnect signal along the interconnect line 26. FIG. 4 illustrates a sample of the interconnect signal along the interconnect line 26 to signal the presence of smoke. Upon detection of smoke, the local detector generates the smoke interconnect signal 33 which transitions from a generally zero voltage level 35 to a +9 volt high state 37. Although a sample of the smoke interconnect signal 33 is shown in FIG. 4, it should be understood that other types of detector systems could include a different type of smoke interconnect signal 33 while operating within the scope of the present invention.

Upon receiving the interconnect signal from the smoke detector 14, both the carbon monoxide detector 12 and the combo detector 16 recognize the representation of the detected smoke condition and generate the correct audible temporal pattern. The combo detector 16 can detect the presence of either smoke or carbon monoxide and generates the different interconnect signals depending upon the type of hazardous condition detected. Based upon the representation of the interconnect signal on the interconnect line 26, the carbon monoxide detector 12 and smoke detector 14 generate the correct temporal pattern for the type of hazardous condition detected and represented by the interconnect signal present on the interconnect line 26.

Although the interconnect signal present on the interconnect line 26 is taught as being a digital signal in the preferred embodiment of the invention, it should be understood that the interconnect signal can take various different forms depending upon the specific configuration of the various detectors 12, 14 and 16. However, in systems that use interconnect signals other than digital, the interconnect signal must still have a different value or pattern depending upon whether the interconnect signal represents a first sensed condition, such as the presence of carbon monoxide, or a second sensed condition, such as the presence of smoke. The at least two different interconnect signals represent the two different types of sensed conditions and are required to ensure that the interconnected detectors generate the correct temporal pattern based upon the detected hazardous condition.

As illustrated in FIG. 1, a multi-function relay module 28 can be connected to the three-wire interconnect system 18. The relay module 28 includes a power input 30, a ground input 32 and an interconnect input 34 that receive the three wires of the three-wire interconnect system 18. The relay module 28 includes an internal relay 36 connected between a normally closed output wire 38, a common, neutral output wire 40 and a normally open output wire 42. The relay 36 includes a movable contact 44 that is selectively movable from the first position shown in FIG. 1 to a second position in which the contact 44 is moved into physical contact with the normally open output wire 42. When the movable contact 44 is moved into contact with the normally open output wire 42, electric power from the source 20 is supplied to the auxiliary devices 46 to activate each of the auxiliary devices. As an example, the auxiliary devices 46 could be strobe lights, sirens, outside lights, exit signals, escape lights, exhaust fans, fire doors or any other type of auxiliary device that may be beneficial upon one of the hazardous condition detectors detecting an alarm condition. Although multiple auxiliary devices 46 are shown in FIG. 1, it should be understood that either a single auxiliary device 46 or any number of auxiliary devices 46 could be connected to the multi-function relay module 28.

Although the auxiliary devices 46 are shown connected to the normally open output wire 42 and are activated upon movement of the movable contact 44, it should be understood that the auxiliary devices 46 could be connected to the normally closed output wire 38 and thus be de-activated when the movable contact 44 moves into contact with the normally open output wire 42. In such a configuration, the auxiliary devices 46 would remain active until the movable contact 44 is moved to the second position.

Figure 2:
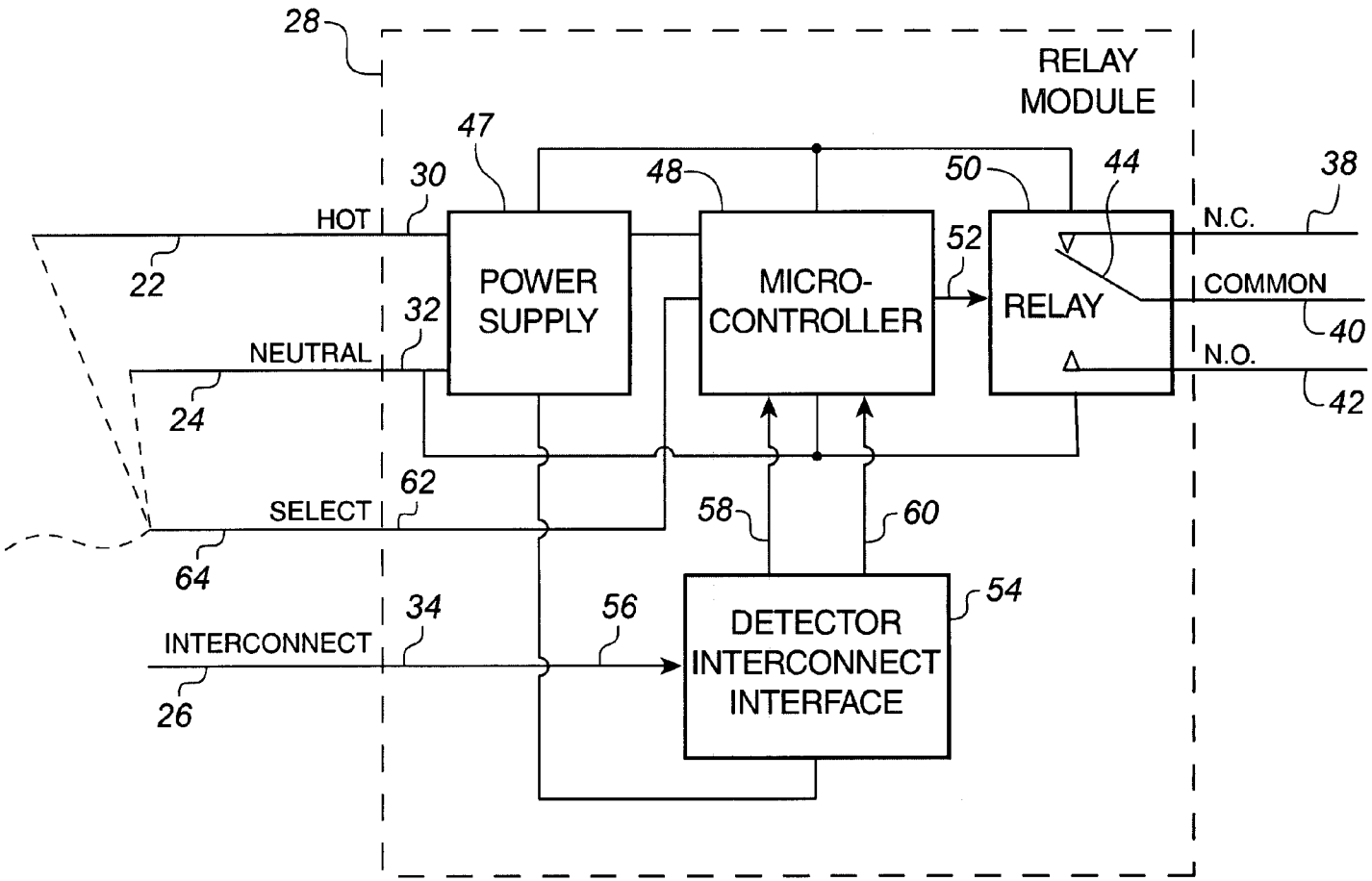
FIG. 2 is a schematic illustration of the internal operating components of the line-powered relay module.

Referring now to FIG. 2, thereshown is a detailed view of the multi-function line-powered relay module 28 constructed in accordance with the present invention. As illustrated, the relay module 28 includes a power supply circuit 47 that receives the supply voltage and regulates the voltage to a value required to operate integrated circuits, namely +5V DC. The power supply 47 is coupled to a control unit 48 that is in operative communication with a relay unit 50 to control the movement of the movable contact 44 between the first position shown in FIG. 2 and a second position in which the contact 44 moves into contact with the normally open wire 42. In the preferred embodiment of the invention shown in FIG. 2, the control unit 48 is a microcontroller connected to the relay unit 50 through a control line 52. The microcontroller can selectively generate a control signal along the control line 52, which causes the relay unit 50 to move the contact 44 between its first and second positions.

In the embodiment of the invention illustrated in FIG. 2, the relay module 28 includes a detector interconnect interface 54 having an input 56 connected directly to the interconnect line 26 through the interconnect input 34 of the relay module. The detector interconnect interface 54 receives the interconnect signal along the interconnect line 26 and interprets the interconnect signal to determine whether the interconnect signal is indicating the presence of the first sensed condition or the second sensed condition. In the embodiment of the invention described, the first sensed condition is the presence of carbon monoxide as detected by one of the interconnected detectors while the second sensed condition is the detection of smoke.

The interconnect interface 54 interprets the interconnect signal received at the input 56 and provides a signal to the control unit 48 on one of the two control lines 58, 60. For example, if the interconnect interface 54 detects the first sensed condition, the interconnect interface provides a high signal along control line 58 which is received by the control unit 48. Alternatively, if the detector interconnect interface 54 determines that the interconnect signal is indicating the detection of the second sensed condition, the interconnect interface 54 provides a high signal to the control unit 48 along the second control line 60. In this manner, the control unit 48 can determine whether the interconnect signal includes an indication of the first sensed condition or the second sensed condition. Although the preferred embodiment of the invention shows the control unit 48 separate from the interconnect interface 54, it should be understood that the interconnect interface 54 could be incorporated into the control unit 48 while operating within the scope of the present invention.

The multi-function line-powered relay module 28 of the present invention further includes a selection input 62 that is directly coupled to the control unit 48. The selection input 62 receives a selection signal from the selection wire 64 coupled to the selection input. In the embodiment of the invention illustrated in FIG. 2, the selection wire 64 is a conventional wire that can be selectively connected to the power supply line 22 or the neutral line 24 by common components, such as wire nuts, or can be left unconnected. The three different positions for the selection wire 64 are shown by dashed lines in FIG. 2.

When the selection wire 64 is connected to the power supply line 22, the control unit 48 receives an AC voltage at its selection input 62. When the selection wire 64 is connected to the neutral line 24, the control unit 48 receives a low, neutral voltage signal at the selection input 62. When the selection wire 64 is left unconnected, the control unit receives a floating voltage, which is interpreted by the control unit as being neither the zero voltage ground level nor the power input voltage level. In this manner, the selection line 64 can provide a selection signal to the control unit 48 having one of three states.

Although the line-powered relay module 28 shown in the Figures is specifically described as being utilized with a series of interconnected hazardous condition detectors, it should be understood that the relay module 28 could be utilized in various other situations in which the mode of operation of the relay module 28 can be selected from one of a plurality of modes of operation. In other applications, the control unit 48 selects the mode of operation based upon the state of the selection signal present at the selection input 62. As described, the state of the selection signal depends upon the connection between the selection wire 64 and either the neutral line 24 or the power supply line 22. The third state of the selection signal is the floating state indicated when the selection wire 64 is left unconnected.

As described above, the control unit 48 receives two separate inputs, namely the selection signal and the interconnect signal, and interprets these signals to selectively control the movement of the movable contact 54 within the relay unit 50. FIG. 3 illustrates the preferred operational decision chart used by the control unit 48. As illustrated, when the selection wire 64 is connected to the power supply line 22, the microcontroller of the control unit 48 is programmed to operate in a first mode and respond only to the presence of the first sensed condition, namely the detection of carbon monoxide. In the embodiment of the invention previously described and shown in FIG. 2, the control unit will receive a high signal on the control line 58 when the interconnect interface 54 detects the presence of the first sensed condition as part of the interconnect signal along the interconnect line 26. Thus, when the control unit receives the first state of the selection signal, namely the AC voltage, the control unit 48 will generate a signal along the control line 52 to move the movable contact to a second position only when the interconnect signal indicates the detection of the first sensed condition, namely carbon monoxide.

Referring back to FIG. 3, when the selective wire 64 is not connected to either the power supply line 22 or the neutral line 24, which corresponds to the second state of the selection signal, the control unit is programmed to operate in a second mode and respond only to the second sensed condition as part of the interconnect signal, namely the detection of smoke. Thus, when the interconnect interface 54 detects that the interconnect signal present on interconnect line 26 indicates the activation of one of the smoke alarms, the interconnect interface provides a high signal along control line 60 which is received by the control unit 48. Since the control unit is detecting the second state at the selection input, the control unit 48 will generate a control signal to the relay unit 50 to move the movable contact 44 to the second position only when a high signal is present on control line 60.

Finally, when the selection wire 64 is connected to the neutral line 24, the microcontroller of the control unit 48 is programmed to operate in a third mode and respond to either the smoke or carbon monoxide alarm signals. Thus, the control unit will generate the control signal along control line 52 upon a high level at either the first control line 58, indicating the presence of the first sensed condition or a high signal along the second control line 60, indicating the presence of the second sensed condition.

As can be understood above, the microcontroller of the control unit 48 is programmed to selectively respond to either the first sensed condition, the second sensed condition or the presence of either one of the first and second sensed conditions based upon the state of the selection input 62. The state of the selection input is determined by whether the selection wire 64 is connected to either the hot, power line 22, the neutral line 24 or is left unconnected to either the power line 22 or the neutral line 24. The microcontroller of the control unit 48 detects the state of the selection input and is programmed to operate in one of three modes and to respond by generating a control signal along line 52 to control the movement of the relay unit 50 based upon the state of the selection signal. Thus, by selectively coupling the selection wire 64 to one of three states, a user can provide a control input to the control unit 48 to select how the control unit 48 will respond to the signal along the interconnect line 26.

Although the present invention has been shown and described with reference to a relay module interconnected within a network of hazardous condition detectors, it should be understood that the relay module 28 could be used in various other applications in which an informational signal is received by the relay module and the relay module selectively responds depending upon the value of the informational signal. The use of the selection wire 64 to determine the mode of operation of the control unit 48 allows the single relay module 28 to be utilized with various different types of situations that can be identified by the value of the interconnect signal.

We claim:

1. A method of selecting the mode of operation of a line-powered module from a plurality of modes of operation, the method comprising the steps of:

providing a selection input on the line powered module, the selection input being in communication with a control unit of the line-powered module;

receiving a selection signal at the selection input, the selection signal having one of a plurality of states;

detecting the state of the selection signal at the control unit; and operating the line-powered module in one of the plurality of modes of operation based upon the state of the selection signal.

2. The method of claim 1 wherein the selection signal includes at least three states.

3. The method of claim 2 further comprising the steps of:

connecting a selection wire to the selection input of the line-powered module;

selectively coupling the selection wire to a power supply to define a first state of the selection signal;

selectively coupling the selection wire toga neutral line to define a second state of the selection signal; and allowing the selection wire to remain unconnected to define a third state of the selection signal.

4. The method of claim 3 wherein the selection wire is removably connectable to the power supply and neutral line such that the state of the selection signal can be modified by adjusting the connection of the selection wire.

5. The method of claim 3 wherein the selection wire is external to the line-powered module.

6. The method of claim 2 further comprising the steps of:

operating the line-powered module in a first mode of operation when the selection signal has a first state;

operating the line-powered module in a second mode of operation when the selection signal has a second state; and operating the line-powered module in a third mode of operation when the selection signal has a third state.

7. The method of claim 6 wherein the first, second and third modes of operation for the line-powered module are different.

8. A line-powered module selectively operable in a plurality of modes of operation, the module comprising:

a control unit operable to selectively control the operation of the module between the plurality of modes of operation;

a selection input coupled to the control unit and operable to receive a selection signal having one of a plurality of states; and a selection wire coupled to the selection input, the selection wire being selectively positionable to define the plurality of states of the selection signal.

9. The module of claim 8 wherein the selection wire is selectively coupled to a power supply to define a first state of the selection signal, wherein the selection wire is selectively coupled to a neutral line to define a second state of the selection signal, and wherein the selection wire remains unconnected to define a third state of the selection signal.

10. The module of claim 9 wherein the control unit is operable to operate the module in a first mode of operation when the selection signal is the first state, wherein the control unit is operable to operate the module in a second mode of operation when the selection signal is the second state, and wherein the control unit is operable to operate the module in a third mode of operation when the selection signal is a third state.

11. The module of claim 10 wherein the first, second and third mode of operation are different.

12. The module of claim 8 wherein the selection wire is removably coupled to a power supply, a neutral line or unconnected to define three states of the selection signal.

* * * * *